United States Patent [19]

Spriggs

[11] Patent Number: 4,622,699

[45] Date of Patent: Nov. 18, 1986

[54] HOSPITAL GOWN

[75] Inventor: Willie Jo Spriggs, Gainesville, Ga.

[73] Assignee: Hospital Corporation of Lanier, Inc., Gainesville, Ga.

[21] Appl. No.: 686,208

[22] Filed: Dec. 26, 1984

[51] Int. Cl.[4] ..... A41B 9/00

[52] U.S. Cl. ..... 2/114; 2/DIG. 7

[58] Field of Search ..... 2/114, 74, DIG. 7

[56] References Cited

U.S. PATENT DOCUMENTS 3,144,661 8/1964 Buser ..... 2/DIG. 7

3,868,728 3/1975 Krzewinski ..... 2/DIG. 7

*Primary Examiner*—Doris L. Troutman

*Attorney, Agent, or Firm*—Jones, Day, Reavis & Pogue

[57] ABSTRACT

A hospital gown comprising a substantially quadrilaterally shaped unitary body portion, adapted to be wrapped around a patient's torso, having an inner, body-contacting surface, an outer surface, an upper edge, first and second longitudinally extending, opposing side edges, and a lower edge; sleeves extending from said outer surface of said body portion, providing communication with said inner, body-contacting surface and adapted for placement of said patient's arms therethrough; at least two non-metallic, elongate securing means extending outwardly and away from each of said first and second side edges, one of each of said securing means being respectively disposed substantially at the juncture of said upper edge with each of said respective first and second side edges, so as to comprise neck portion securing means extending substantially parallel to said upper edge and outwardly and away from each of said side edges; two non-metallic, elongate securing means extending outwardly and away from said upper edge, and being disposed about the longitudinal middle of said edge each being adapted for securing to the opposite neck portion securing means of said first and second side edges; at least one inner surface, non-metallic elongate securing means, extending inwardly and away from said inner body-contacting surface of said body portion, being adapted for securing to one of said first edge elongate securing means; and at least one outer surface, non-metallic elongate securing means, extending outwardly and away from said outer surface of said body portion, being adapted for securing to one of said second edge elongate securing means.

5 Claims, 6 Drawing Figures

HOSPITAL GOWN

BACKGROUND OF THE INVENTION

1. Field of the Invention

This invention relates generally to hospital gowns to be worn by a patient while in a hospital, particularly when undergoing diagnostic procedures, in a doctor's examination room, or while otherwise undergoing in- or out-patient medical treatment or diagnostic procedures.

2. Description of Related Art Including Information Disclosed under 37 CFR § 197-1.99.

Hospital gowns have long been the bane of physician and patient both, although from different perspectives and for different reasons. Physicians and hospital personnel prefer a gown that minimizes obstruction of their physical access to the patient's body, is relatively inexpensive and susceptible to manufacture and use in generic sizes, and is easy to use to dress and undress patients who might otherwise have difficulty in donning and removing the garment. Hospital gowns without sleeves, loose-fitting and with either an open back and ties or simple metal snaps for securing the garment about the patient, as are known to the art, are the gown of choice from that viewpoint.

The manner of securing the garment may have a negative impact upon both the patient and other hospital personnel. While patients often prefer the ease of metal snaps, or even zippers, such devices provide a source of undesired interference and confusion to diagnostic procedures. This is particularly so where a gowned patient is to undergo X-ray or computerized axial tomograph analysis, as well as the newer nuclear and magnetic resonance imaging techniques. Cloth ties, while obviating these diagnostic difficulties, tend to lie in inaccessible areas of the body in the known hospital gowns, such as along the patient's back. This makes donning and doffing of the garment by oneself virtually impossible. The known gown closure systems using ties tend to bridge the major opening in the garment with those ties. This leaves a gap in the garment, particularly as the ties loosen, which tends to expose portions of the patient's body— particularly the areas societally identified as the "private parts".

This last shortcoming—the inability to maintain coverage of the body in the manner of choice—is the biggest drawback from a patient's viewpoint. The difficulty in dressing and undressing oneself, taken with the general unattractiveness of the known loose, blousy, non-formfitting gowns, were also severe shortcomings.

The prior art suggested a variety of solutions to these problems. See, e.g., Barron U.S. Pat. No. 4,215,434; Blume U.S. Pat. No. 4,205,398; Bradley U.S. Pat. No. 3,745,587; Belkin U.S. Pat. No. 3,729,747; Keltner U.S. Pat. No. 3,490,072; Hoegerman U.S. Pat. No. 3,464,063; Bradley U.S. Pat. No. 3,399,406; Zimmon U.S. Pat. No. 3,353,189; Richter U.S. Pat. No. 3,218,649; Derrick U.S Pat. No. 3,155,984; Severance U.S. Pat. No. 2,331,051; A. C Daniels Great Britain Pat. No. 1,062,516; Philips U.S. Pat. Des. No. 263,345; Banks U.S. Pat. Des. No. 236,293; and Snider U.S. Pat. Des. No. 233,634. None of the hospital gowns disclosed, however, solved the problems and shortcomings from the standpoints of the physician and hospital personnel, medical diagnostic personnel, and the patient.

There existed a definite need in the art for a novel hospital gown. The optimum combination of properties for such a gown would comprise:

(1) A gown having fasteners which did not interfere in any manner with the carrying out of medical diagnostic or analysis procedures with respect to the patient while wearing it, yet which were easy to secure and release by either an unaided patient or medical and hospital personnel;

(2) The gown would be relatively inexpensive, while still affording attractiveness and form fit despite its being fashioned so as to allow generic or "one size fits all" sizing;

(3) Maximum coverage of the patient's body, particularly private areas, would be afforded, but physical access to the patient's body would be readily gained when necessary to the physician's examination or other treatment of the patient;

(4) No gaps or open joints between gown edges would be provided, whether along closure portions or otherwise; and (5) The hospital gown could be made of a fabric-like and/or sterilizable material.

None of the hospital gowns now available provide this optimum combination of properties.

SUMMARY OF THE INVENTION

The present invention relates to a hospital gown to be worn by a patient while undergoing medical treatment or diagnostic procedures.

The hospital gown of the invention comprises:

a substantially quadrilaterally shaped unitary body portion, adapted to be wrapped around a patient's torso, having
- an inner, body-contacting surface,
- an outer surface,
- an upper edge,
- first and second longitudinally extending, opposing side edges, and
- a lower edge;

sleeves extending from said outer surface of said body portion, providing communication with said inner, body-contacting surface and adapted for placement of said patient's arms therethrough;

at least two non-metallic, elongate securing means extending outwardly and away from each of said first and second side edges,
- one of each of said securing means being respectively disposed substantially at the juncture of said upper edge with each of said respective first and second side edges, so as to comprise neck portion securing means extending substantially parallel to said upper edge and outwardly and away from each of said side edges;

two non-metallic, elongate securing means extending outwardly and away from said upper edge, and being disposed about the longitudinal middle of said edge, each being adapted for securing to the opposite neck portion securing means of said first and second side edges;

at least one inner surface, non-metallic elongate securing means, extending inwardly and away from said inner, body-contacting surface of said body portion, being adapted for securing to one of said first edge elongate securing means; and at least one outer surface, non-metallic elongate securing means, extending outwardly and away from said outer surface of said body portion, being adapted for securing to one of said second edge elongate securing means.

The present invention overcomes the drawbacks of the prior art by providing a hospital gown having fasteners which do not interfere in any manner with the performance upon the patient wearing said gown of medical diagnostic or analysis procedures, and are easy to secure and release by either an unaided patient or medical and hospital personnel; which is relatively inexpensive, allows fitment to a variety of patients through generic or "one size fits all" sizing, and affords attractiveness and relative form fit to the patient; provides maximum coverage of the patient's body, particularly the private areas, while allowing ready physical access to the patient's body for patient examination or treatment, yet does not have gaps or open joints between gown edges along closure portions or otherwise; and which may be made of a fabric-like and/or sterilizable material.

Accordingly, it is an object of this invention to provide an improved hospital gown which is easily secured and released by an unaided patient and/or medical and hospital personnel without use of fastening means which interfere in any manner with the performance upon a patient wearing the gown of medical diagnostic or analysis procedures.

It is a further object of this invention to provide an improved hospital gown which affords attractiveness and relative form fit while allowing fitment to a variety of patients through generic sizing, and which may be manufactured of a fabric-like and/or sterilizable material.

It is another object of this invention to provide an improved hospital gown which maximizes coverage of the patient's body and private areas, and does not present gaps or open joints between gown edges or along closure points, while still allowing ready physical access to the patient's body for patient examination or treatment.

Other objects and advantages of this invention will become apparent upon reading the following detailed description and appended claims.

DESCRIPTION OF THE PREFERRED EMBODIMENTS

Figure 1:
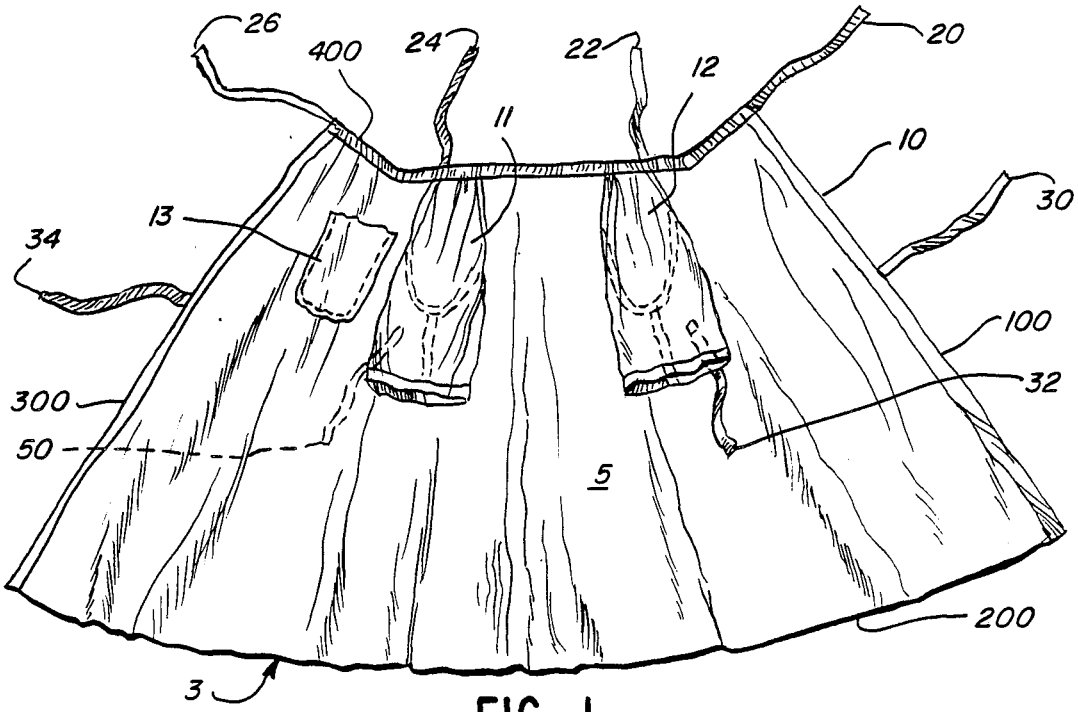
FIG. 1 is a plan view of the gown of the invention laid out on its inner, body-contacting surface.

The preferred embodiment of the invention is most readily described by reference to the Figures. FIG. 1 illustrates a hospital gown 10 of the invention. The gown may be made of any of the materials heretofore well known to the art for hospital gown use. Useful materials for fabrication of the gown include continuously extruded, synthetic material or composites of such materials, particularly in continuous sheet form prior to fabrication; woven natural fiber or synthetic fiber materials, including woven cloth and other woven fabric-like material constructed from cotton, cotton blended with synthetics (such as polyester, nylon, polypropylene and the like), and polyester, nylon, polypropylene or other synthetics; and non-woven natural fiber or synthetic fiber materials.

Gown 10 comprises a substantially quadrilaterally shaped unitary body portion, preferably cut from one sheet of material. Alternately, the gown 10 may be constructed of panels or pieces of material fastened together, such as by sewing and/or adhesive bonding, into a continuous, unitary body. Any construction which affords a continuous, unitary body with no back opening may be used. Gown 10 has an upper edge 400, first and second longitudinally extending, opposing side edges 100 and 300, and a lower edge 200. If desired, slits may be provided extending upwardly from edge 200 into the body for a short distance, to maximize leg movement and walking ease.

Figure 2:
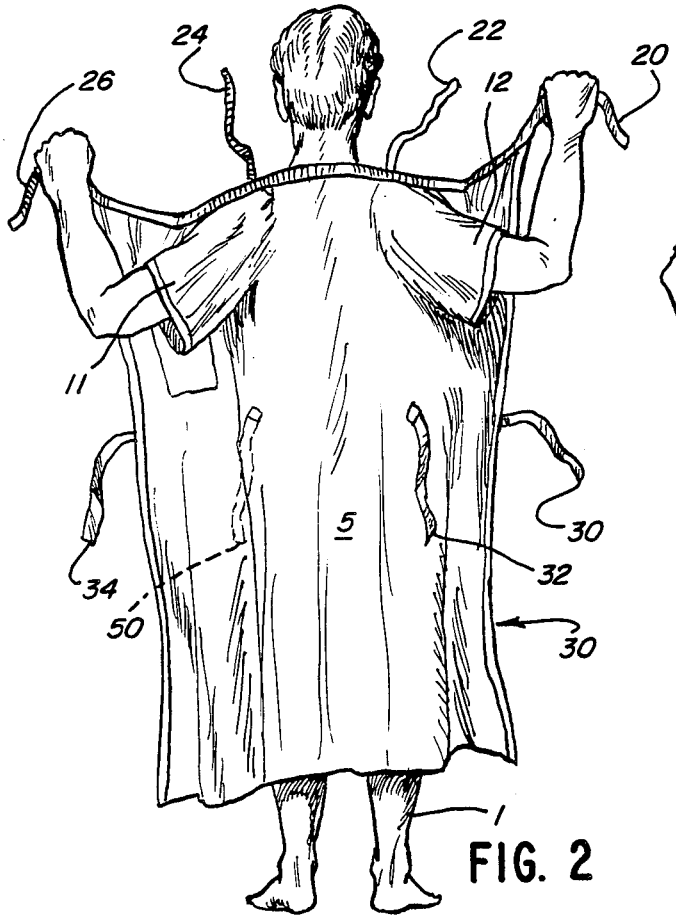
FIG. 2 is a rear view of a patient having put on without fastening the gown of the invention.
Figure 3:
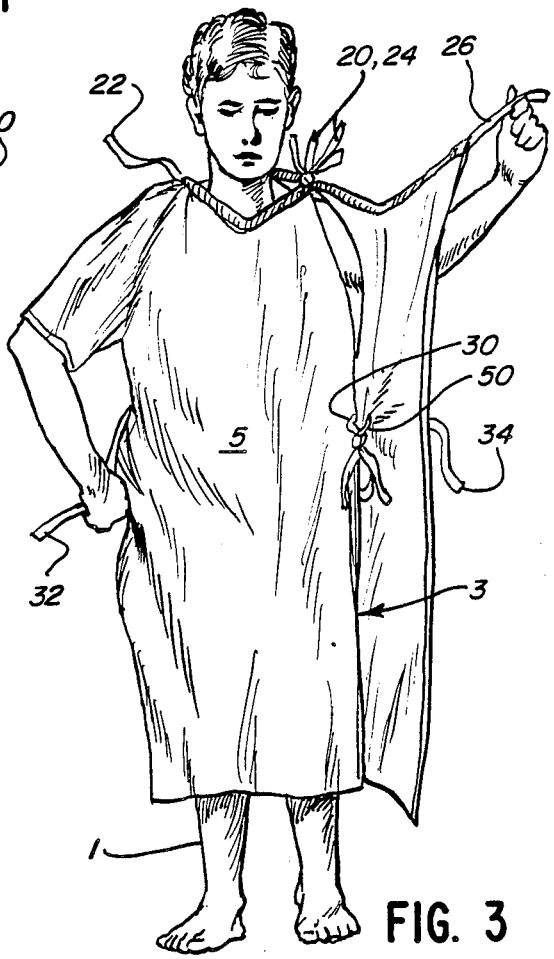
FIG. 3 is a front view of a patient part way through the fastening sequence for the gown of the invention.

The gown 10 has an inner, body-contacting surface 3 and an outer surface 5 (FIGS. 1–3). Approximately two-thirds of the inner surface 3 actually comes into contact with the patient's body (see FIGS. 2–3). The remaining approximately one-third of that surface contacts a portion of outer surface 5 when the patient has completed donning and fastening the gown (see FIGS. 3–5). If desired, that portion of the inner, body-contacting surface 3 which actually contacts the patient's body may be furnished with an additional layer of material, or comprise a composite of materials. A removable layer fastened to said portion of inner surface 3 by the well-known Velcro® fastening system may be provided, that layer preferably comprising dressing material or a controlled-release medicine or other liquid-comprising material.

Figure 5:
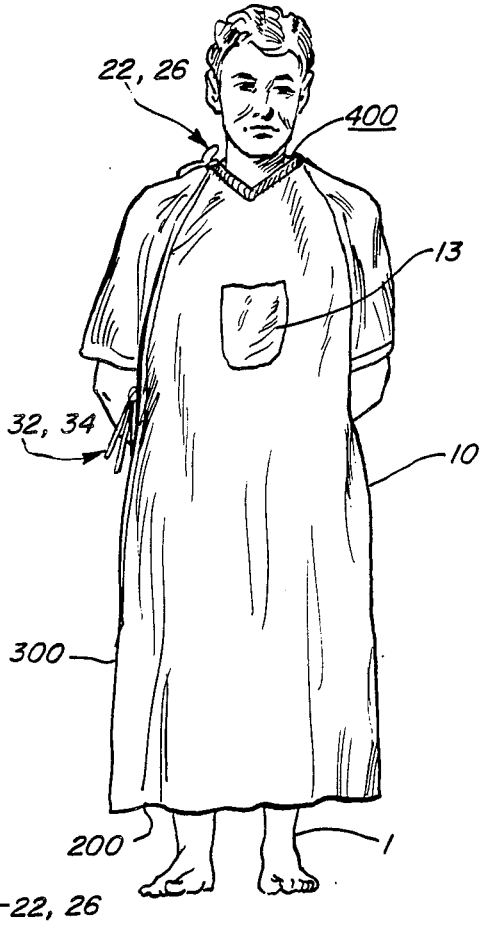
FIG. 5 is a front view of a patient after completion of the fastening sequence for the gown of the invention.

Sleeves 11 and 12 extend outwardly from the outer surface 5 of the unitary body portion of gown 10. As sleeves do, sleeves 11 and 12 communicate through armholes with the inner, body-contacting surface 3 of the gown 10, so that a patient may place his arms therethrough, as FIG. 2 shows patient 1 doing. While any manner of sleeve construction may be used, including sleeves continuously woven as part of the unitary body portion of the gown, a raglan sleeve construction such as is illustrated in FIGS. 1, 3 and 5 is preferred. This construction maximizes patient comfort and mobility, as well as making the donning of the garment easier. This latter capability is of particular advantage when hospital or medical personnel have to place gown 10 on an unconscious or comatose patient, or a patient otherwise unable to dress himself, especially when the patient is in a supine position.

Each of side edges 100 and 300 is provided with at least two non-metallic, elongate securing means, such as means 20 and 30 disposed so as to extend outwardly and away from edge 100, and means 26 and 34 similarly disposed with respect to edge 300. At least one of each of the two or more securing means is preferably placed along edges 100, 300 so as to lie proximate to the corner formed by the juncture with upper edge 400. Securing means 20 is affixed and disposed substantially at the juncture of upper edge 400 and side edge 100, and extends in a direction substantially parallel to edge 400 and outwardly and away from side edge 100 (FIG. 1). Similarly, securing means 26 is affixed and disposed substantially at the juncture of upper edge 400 and side edge 300, and extends in a direction substantially parallel to edge 400 and outwardly and away from side edge 300 (FIG. 1). Means 20, 26 comprise neck portion securing means, as will be more fully described herein.

The at least one additional non-metallic, elongate securing means 30 and 34 affixed to side edges 100 and 300 respectively may be positioned anywhere along said edges. It is most preferable to place said additional means 30, 34 at approximately the midpoint of said edges, or "waist-high", as illustrated in FIGS. 1, 3. A third non-metallic, elongate securing means may then be placed along each of said edges 100, 300 at a location between means 30 and 34 and bottom edge 200, if desired, to maximize cover of the patient's lower torso and private areas.

Additional non-metallic, elongate securing means 22 and 24, which extend outwardly and away from upper edge 400, complete the neck closure structure of gown 10. Means 22, 24 are preferably equidistantly positioned about the longitudinal middle or centerline of edge 400, so as to be equally spaced on either side of patient 1's neck (FIG. 2). Each of means 22, 24 is adapted for securing to the opposite neck portion securing means 20, 26 of said first and second side edges 100, 300 respectively. In other words, neck portion securing means 20 is adapted to be secured with corresponding means 24 depending from edge 400, and neck portion securing means 26 is adapted to be secured with corresponding means 22 depending from edge 400 (FIGS. 3–4).

The neck closure structure of gown 10 is particularly illustrated in FIGS. 2–5, which show the sequence of closing the neck of gown 10. The patient first puts on gown 10 by placing his arms through sleeves 11, 12 (FIG. 2). Means 20, 26 may be grasped proximate their points of affixation to gown 10 to aid in that step. Means 20 is then secured to means 24 (FIG. 3). Each of the non-metallic, elongate securing means 20, 30, 22, 24, 26, 32, 34 and 50 are preferably flexible, elongate straps. Such straps are most preferably cloth tapes of natural or synthetic fiber, or strings or ties of the type known in the art. Securing of one such means to another may be performed by tying in a bow knot or other knot.

Figure 4:
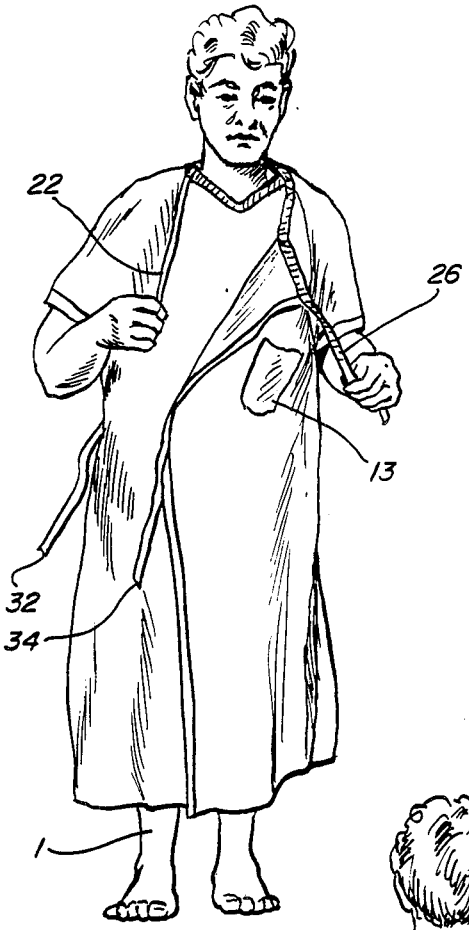
FIG. 4 is a front view of a patient continuing the fastening sequence for the gown of the invention.
Figure 6:
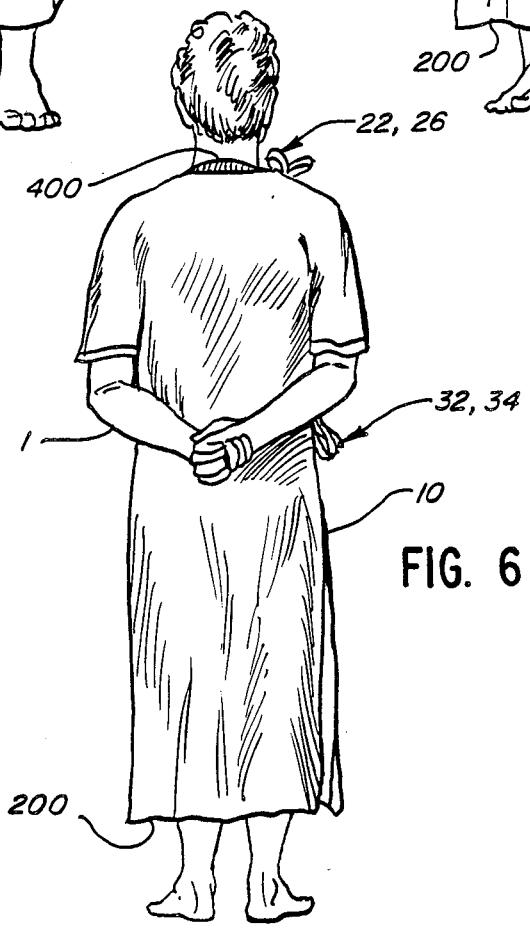
FIG. 6 is a rear view of a patient after completion of the fastening sequence for the gown of the invention.

Thereafter, means 26 is secured to means 22, as shown in the sequence of FIGS. 3, 4 and 5. This second closure completes the neck closure of the gown 10, as shown in FIGS. 5 and 6, and provides a comfortable yet easily releasable and openable structure.

The preferred torso closure structure of gown 10 is best illustrated in FIGS. 1–5. An inner surface, non-metallic elongate securing means 50 is provided on inner, body-contacting surface 3, affixed and disposed so as to extend inwardly and away from said surface 3 (FIGS. 1–2). Means 50 is adapted for securing to first edge 100 elongate securing means 30, in the manner previously described. An outer surface, non-metallic elongate securing means 32 is also provided on surface 5, affixed and disposed so as to extend outwardly and away from said surface 5 (FIGS. 1–2). Means 32 is adapted for securing to second edge 300 elongate securing means 34, again in the manner as previously disclosed.

FIGS. 2–5 illustrate the gown 10's body portion closure structure. After having put on the gown 10 (FIG. 2), means 30 is secured to means 50 (FIG. 3), and means 34 is secured to means 32 (FIGS. 3–5). The structure of said means and the methods of securement are as previously described.

Considering the gown 10 and its closure structures as a whole, the sequence of putting on the gown is as follows. The patient first puts on the gown 10, either himself or with the aid of medical or hospital personnel, by slipping his arms into sleeves 11, 12 (FIG. 2). If the patient is unable to put on the gown even with hospital personnel aid, such as in the case of a comatose patient, the gown may be spread out, in the manner shown in FIG. 1, on a bed or other flat surface so that inner body-contacting surface 3 faces outwardly, and the patient placed on said surface 3, back-first. His arms may then be placed into sleeves 11, 12, or they may be simultaneously placed into said sleeves as the patient is placed onto said surface 3.

Means 20 is then secured to means 24, and means 30 secured to means 50, as illustrated in FIG. 3, substantially covering the patient's body, through the crossing over of edge 100 with respect to the front of patient 1, save where that edge abuts surface 3. Means 22 is then secured to means 26 and means 32 secured to means 34, as illustrated in FIG. 4. This causes edge 300 to cross over the front of patient 1 (FIGS. 3–5).

The resulting closed gown 10 is illustrated in FIGS. 5 and 6. Secured means 22/26 and 32/34 lie proximate to the patient's side, and are easily reached by the patient, or medical or hospital personnel, for either unsecuring or retightening that securement if necessary. No gap is left between outermost edge 300 and any other part of gown 10, such that the patient's body is completely enclosed. If direct access to the entire patient's body is necessary in either a supine, sitting or standing position, the gown 10 may easily be opened by first unfastening means 22 from means 26, and means 32 from means 34, carrying edge 300 across patient 1 to resume the orientation shown in FIG. 3, then unfastening means 20 from means 24 and means 30 from means 50, and carrying edge 100 across patient 1 to resume the orientation shown in FIG. 2.

If access to only the upper portion of the patient's body is necessary, the sequence may involve only the unfastening of means 22/26 and 20/24. If access to only the lower portion of the patient's body is necessary, the sequence may involve only the unfastening of means 32/34 and 30/50. Hence, only so much of the patient's body as need be is exposed, maximizing both the patient's desire to preserve modesty and decorum and the physician's or medical personnel's need for access.

Patients undergoing medical diagnostic procedures often move from location to location, and certain records must perforce move with them. To minimize the potential for separating patient and records, gown 10 is preferably furnished with a pocket such as pocket 13, which is readily accessible to both patient 1 and his physician or attendant medical personnel.

While particular embodiments of the invention, and the best mode contemplated by the inventor for carrying out the invention, have been shown, it will be understood, of course, that the invention is not limited thereto since modifications may be made by those skilled in the art, particularly in light of the foregoing teachings. It is, therefore, contemplated by the appended claims to cover any such modifications as incorporate those features which constitute the essential features of these improvements within the true spirit and scope of the invention.

I claim:

1. An unhooded hospital gown consisting essentially of a substantially quadrilaterally shaped unitary body portion, adapted to be wrapped around a patient's torso and extending in length at least to said patient's knees, having an inner, body-contacting surface, an outer surface, an upper edge, first and second longitudinally extending, opposing side edges, and a lower edge;

sleeves extending from said outer surface of said body portion, providing communication with said inner, body-contacting surface and adapted for placement of said patient's arms therethrough;

two non-metallic, elongate securing means extending outwardly and away from each of said first and second side edges, one of each of said securing means being respectively disposed substantially at the juncture of said upper edge with each of said respective first and second side edges, so as to comprise neck portion securing means extending substantially parallel to said upper edge and outwardly and away from each of said side edges;

two non-metallic, elongate securing means extending outwardly and away from said upper edge, and being disposed about the longitudinal middle of said edge, each being adapted for securing to the opposite neck portion securing means of said first and second side edges;

at least one inner surface, non-metallic elongate securing means, extending inwardly and away from said inner, body-contacting surface of said body portion, being adapted for securing to one of said first edge elongate securing means;

at least one outer surface, non-metallic elongate securing means, extending outwardly and away from said outer surface of said body portion, being adapted for securing to one of said second edge elongate securing means; and pocket means disposed on said outer surface of said body portion when said gown is wrapped and secured about said patient's torso.

2. The hospital gown of claim 1 wherein said body portion is comprised of a fabric-like material.

3. The hospital gown of claim 1 or 2 wherein said non-metallic, elongate securing means comprise flexible, elongate straps.

4. The hospital gown of claim 1 or 2 comprised of a sterilizable material.

5. The hospital gown of claim 3 wherein said body portion and said elongate securing means comprise fabric-like material.

* * * * *